US005970298A

United States Patent [19]

Seki et al.

[11] Patent Number: 5,970,298

[45] Date of Patent: Oct. 19, 1999

[54] FIXING METHOD AND DEVICE WITH A CONTROLLABLE WEB SYSTEM AND IMAGE FORMING APPARATUS INCORPORATING THE METHOD DEVICE AND SYSTEM

[75] Inventors: Takayuki Seki, Yokohama; Masahiko Satoh, Funabashi, both of Japan

[73] Assignee: Ricoh Company, Ltd., Tokyo, Japan

[21] Appl. No.: 09/066,958

[22] Filed: Apr. 28, 1998

[30] Foreign Application Priority Data

Apr. 28, 1997 [JP] Japan ..... 9-110907
Jun. 6, 1997 [JP] Japan ..... 9-149152

[51] Int. Cl.[6] ..... G03G 15/20

[52] U.S. Cl. ..... 399/327; 399/326

[58] Field of Search ..... 399/327, 326, 399/325, 352, 345, 346, 123

[56] References Cited

U.S. PATENT DOCUMENTS 5,168,314 12/1992 Gunji et al. ..... 399/327
5,850,588 12/1998 Yoshikawa ..... 399/327

FOREIGN PATENT DOCUMENTS 58-205179 11/1983 Japan .
59-146075 8/1984 Japan .
62-047671 3/1987 Japan .
2-280182 11/1990 Japan .
2-284184 11/1990 Japan .
4-180080 6/1992 Japan .
8-171307 7/1996 Japan .
8-185086 7/1996 Japan .
9-106210 4/1997 Japan .

*Primary Examiner*—Arthur T. Grimley
*Assistant Examiner*—Quana Grainger
*Attorney, Agent, or Firm*—Oblon, Spivak, McClelland, Maier & Neustadt, P.C.

[57] ABSTRACT

A device, and method implemented by the device, employs a fixing device to heat and apply pressure to an image forming substance held on an image holding member so as to affix the image forming substance on the image holding member. The device includes a web and a web driving mechanism that operate under the control of a controller. The controller controls a movement of the web to clean a nip portion of the fixing device during a suspending mode of operation. By moving the web against the fixing unit during the suspending mode of operation, the residual image forming substance is prevented from remaining on the fixing device for too long of a period of time, thereby lowering the risk of damaging the fixing unit, which may occur if the residual image forming substance is removed from the fixing device after being secured attached to the fixing device.

20 Claims, 8 Drawing Sheets

SUSPENDING PERIOD
COPYING PERIOD
SUSPENDING PERIOD
COPYING PERIOD
TIME
COPY FINISH
COPY START
COPY FINISH
COPY START
BACKGROUND ART
MOVING PERIOD
Y
X

APPARATUS

WEB
ON
OFF

WEB ON
OFF

SUSPEND PERIOD
COPY PERIOD
COPY START
H
IRREGULAR OCCURS
(G)

APPARATUS

ON
HEATER OFF

ON
WEB OFF

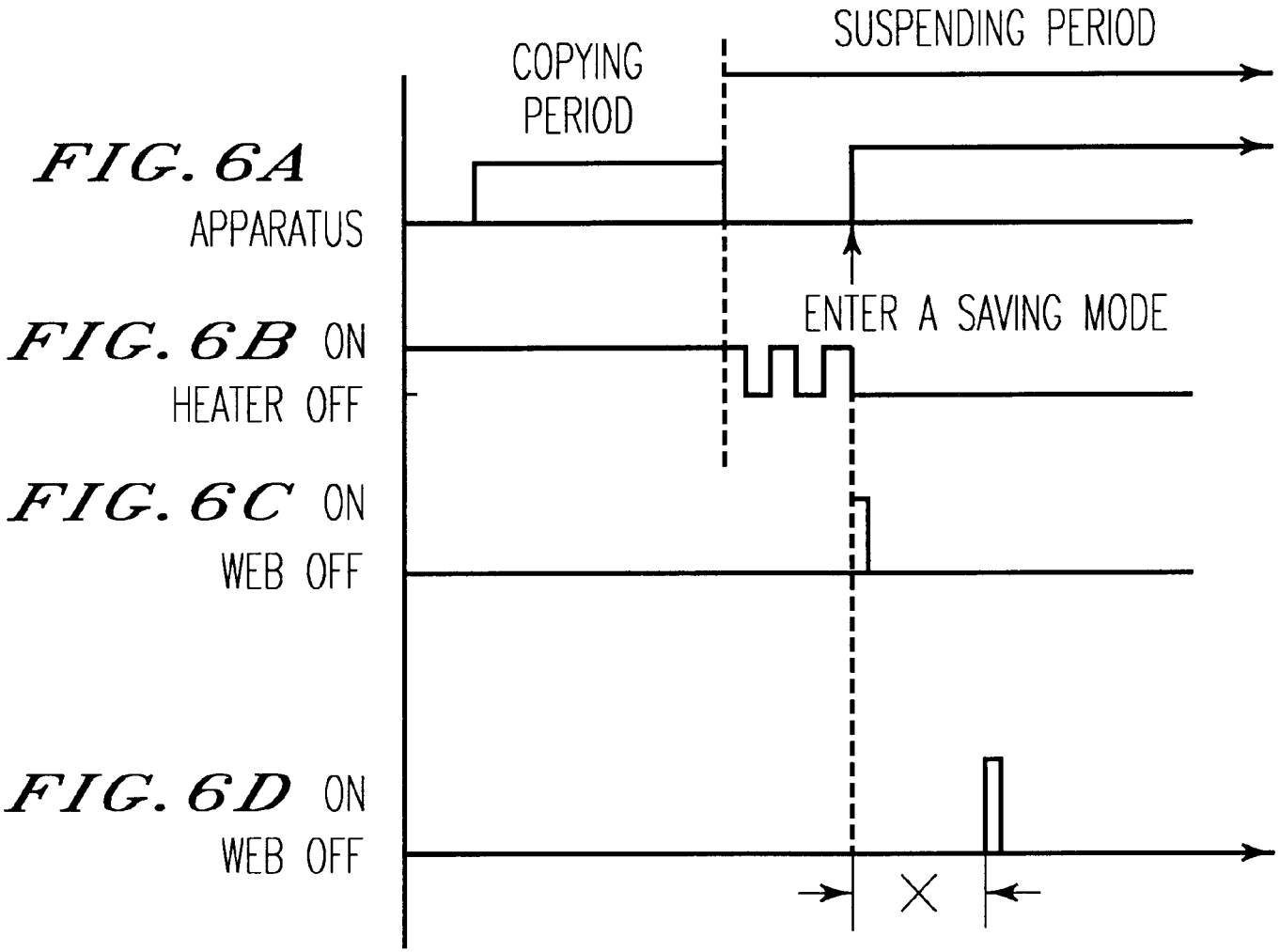
COPYING PERIOD
SUSPENDING PERIOD
ENTER A SAVING MODE
X
FIG. 6A APPARATUS
FIG. 6B ON HEATER OFF
FIG. 6C ON WEB OFF
FIG. 6D ON WEB OFF

FIXING METHOD AND DEVICE WITH A CONTROLLABLE WEB SYSTEM AND IMAGE FORMING APPARATUS INCORPORATING THE METHOD DEVICE AND SYSTEM

CROSS REFERENCE TO RELATED PATENT DOCUMENTS

The present document contains subject matter related to that contained in co-pending U.S. application Ser. No. 08/615,438 entitled "Fixing Device With Cleaning Device For Cleaning Fixing Roller" filed Mar. 14, 1996; co-pending U.S. application Ser. No. 08/628,270 entitled "Fixing Apparatus" filed Apr. 5, 1996; co-pending U.S. application Ser. No. 08/759,929 entitled "Image Fixing Device, Image Forming Apparatus Providing The Image Fixing Device And Rotor Used In The Image Fixing Device And Having Induction Core Inside" filed on Dec. 4, 1996; U.S. Pat. No. 5,300,996 entitled "Fixing Apparatus" issued Apr. 5, 1994; U.S. Pat. No. 5,625,442, entitled "Fixing Device Having A Cleaning Blade" issued Apr. 29, 1997; Japanese Laid Open Patent Application 59-30575 published Feb. 18, 1984; Japanese Laid Open Patent Application 59-84274 published May 15, 1984 and Japanese Laid Open Patent Application 06-186874 published Jul. 8, 1994, the entire contents of each of which are incorporated herein by reference.

BACKGROUND OF THE INVENTION

1. Field of the Invention

The present invention relates to devices and methods, such as those employed in image forming devices, that include a fixing device that fixes an image forming substance, such as toner, to a recording sheet, such as paper or an overhead projection film, for example, so as to make a recorded image on the recording sheet. More particularly, the present invention relates to devices and methods that include a cleaning web that cleans residual image forming substance on the fixing device and in some circumstances also applies a light coat of oil to the fixing device.

2. Discussion of the Background

Conventional image forming devices include a fixing device that fixes toner on a recording sheet, where the toner is arranged in a pattern that corresponds with an original image. In order to fix the toner to the recording medium, the recording medium is passed through a fixing device, which heats and applies pressure to the toner on the recording sheet, so as to permanently affix the toner to the recording sheet.

FIG. 1 shows an example of one type of conventional fixing device that includes a web 4 for cleaning a heat roller 1 during a copying operation. The conventional apparatus includes a heating element 3 contained in the heat roller 1. The heating element 3 is controlled by a basic controller 11 as shown. A press roller 2, is placed in press contact with the heat roller 1, and rotated in an opposite direction to the heat roller 1, as shown by the arrow in FIG. 1. A recording paper may be passed between the respective rollers 1 and 2, in which heat from the heater 3, and pressure from the press roller 2, combined to fix the toner to the recording sheet. The recording sheet then is exited from the image forming apparatus. However, some of the toner "T" remains on the heat roller 1, and unless removed, will adversely effect image quality and perhaps damage the heat roller 1 as will be discussed.

Under control of the basic controller 11, the web 4, which is payed out from a pay-out roller 6, is brought into contact with the surface of the heat roller 1, so as to clean the residual toner from the surface of the heat roller 1. The tension roller 9 is biased by a spring toward the surface of the heat roller 1 so as to keep the web 4 in contact with the heat roller 1. The take-up roller 8, is actuated by a motor 7 under control of the basic controller 11 so as to pull the web 4 during the copy mode of operation.

In the conventional apparatus, the web 4 is used only during a cleaning operation (which occurs during the copying operation) to avoid exhausting the entire supply of the web 4 in too rapid a period of time. Moreover, as the toner is applied against the heat roller 1 only during the copying operation, the conventional approach is to operate the movement of the web 4 only during the copying operation. To this end, the basic controller 11 is programmed to actuate the motor 7 to drive the take up roller 8, and pull the web 4 from the pay-out roller 6 during the copying mode of operation.

Japanese Application JP 59-84274, is an example of such a conventional device where a control circuit controls the motion of a web and moves the web only during a light exposure process (i.e., an image forming, or copying, process). Moving the web for only this period of time is explained in JP 59-84274 as a way of avoiding the wasteful feeding of the web and to extend the replacement period of the web.

Japanese Application JP 6-186874 is directed to a fixing device that after a predetermined number of fixing operations applies a releasing agent to the fixing roller while the temperature of the fixing roller is restored to a predetermined temperature. Driving a web in such a device is not synchronized with the application of the releasing agent.

Another conventional apparatus is disclosed in Japanese Application JP 57-141553 and first detects a temperature of a fixing roller, and operates only when the heat roller is above a predetermined temperature, but not below a predetermined temperature so as to avoid the unnecessary consumption of the web.

The present inventor identified that a failure mechanism of conventional fixing devices, is that a separation layer (such as a non-stick, TEFLON layer) applied to a heating roller can be damaged unless the roller is cleaned in the contact area and the area adjacent to where the web contacts the heat roller 1. Moreover, in reference to FIG. 7, a heat roller 1 is shown to be brought into contact with the web 4, in a nip portion "N". Because the greatest force of the press roller 9, as applied to the heat roller 1, occurs at a central portion, see the dashed line in FIG. 7, residual toner, dust and other potential contaminating materials "W" collect at the edge of the nip portion N and continue up to the center of the nip portion N. However, if after the copying operation this material is not removed, the present inventor has determined that the impurities "W", adhere strongly to the heat roller 1, particularly when the heat roller 1 cools, perhaps after the copying operation, or if another event such as a paper jam or other problem occurs. Furthermore, if the material "W" stays on the heat roller 1 for an extended period of time, even if the heat roller 1 does not reduce in temperature, the attaching force of the material "W" to the heat roller 1 becomes excessive. Consequently, during a subsequent web moving operation, the material "W," which is to the separation layer of the heat roller 1, causes the portion of the separation layer that is in contact with the material "W" to tear-off. As a consequence, the heat roller 1 becomes damaged and subsequently performs poorly in future fixing operations. The symptom experienced is that the material "W", sticks to the recording medium and results in poor adhesion of toner onto the recording medium.

SUMMARY OF THE INVENTION

The present invention is made in light of the above described, and other problems associated with conventional fixing devices, fixing methods and image forming devices generally and it is an object of this invention to address these and other problems. A fixing device, and corresponding method according to the present invention controls an amount by which a web in the fixing device moves, during a non-copying mode of operation. The device and method incorporate a controller that moves the web by an amount at least equal to half of a nip portion, between a press roller and a heat roller, so as to clear the nip portion and an adjacent portion of toner, dust and other contaminants that may have collected at the nip portion and in the portion immediately adjacent to the nip portion. The controller is configured to move the web during a non-copy mode of operation, at certain times, and based on certain events. For example, a non-exhaustive list of times and events includes after a copying mode of operation has been performed, a certain period of time after an irregularity occurs, after the heater is turned off, during a suspended period of operation.

BRIEF DESCRIPTION OF THE DRAWINGS

A more complete appreciation of the present invention and many of the attendant advantages thereof will be readily obtained as the same becomes understood by reference to the following detailed description when considered in connection with the accompanying drawings, wherein:

FIGS. 6A–6D, are timing diagrams of an apparatus operating period, heater operating period, web operating period, and a web operating period according to an alternative embodiment during an energy saving mode of operation;

DESCRIPTION OF THE PREFERRED EMBODIMENTS

Figure 1:
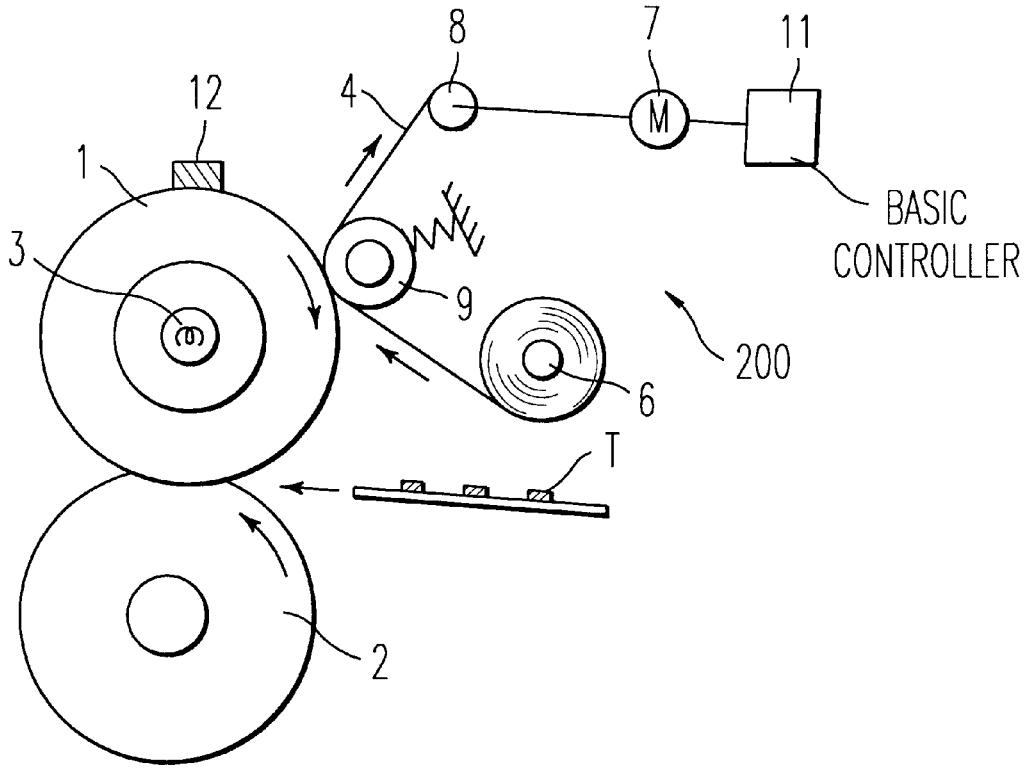
FIG. 1 BACKGROUND ART
FIG. 1 is a side view of a conventional fixing device according to the background art.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Figure 2:
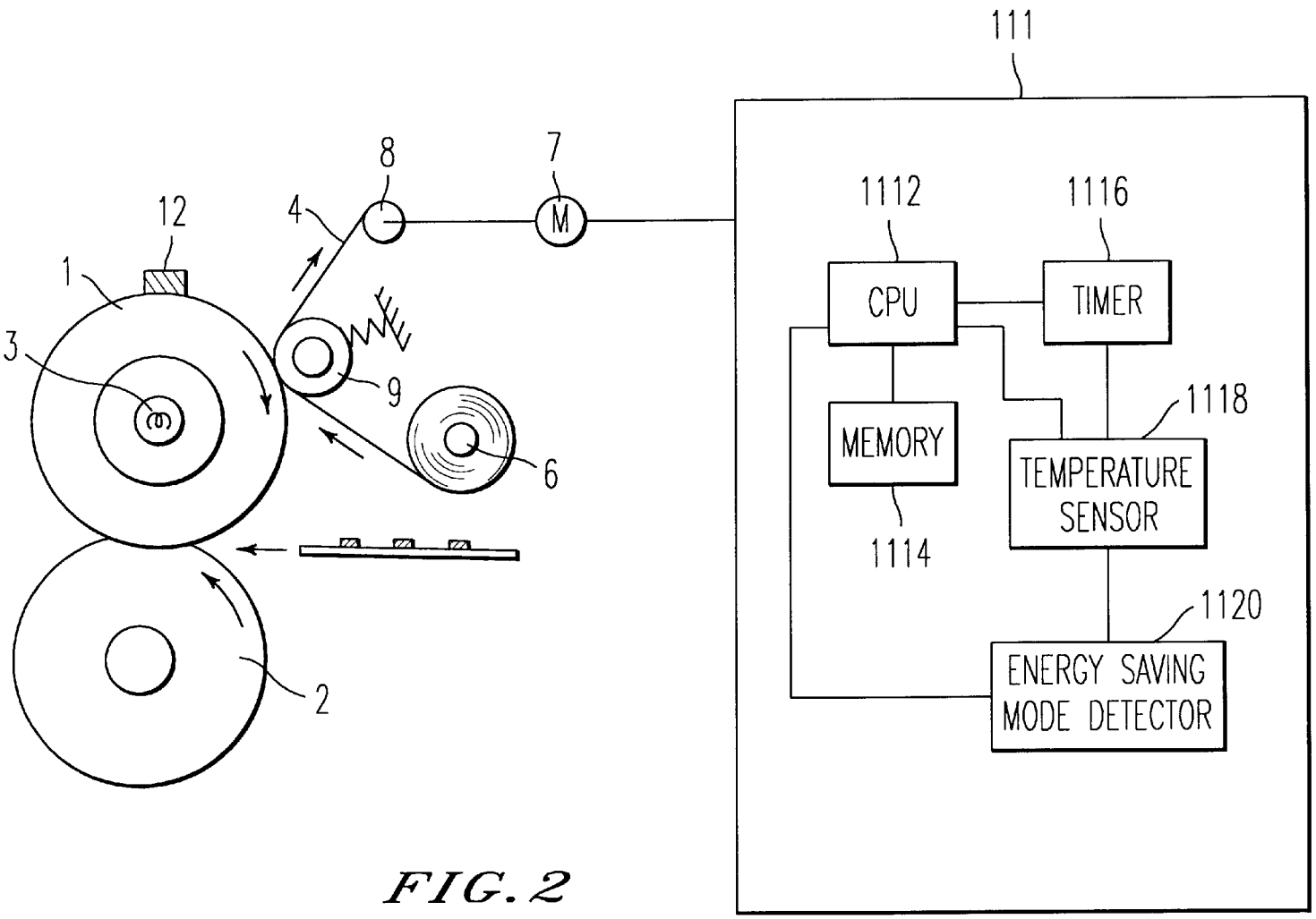
FIG. 2 is a side view of a fixing device, including a controller, according to the present invention.

Referring now to the drawings, wherein like reference numerals designate identical or corresponding parts throughout the several views, and more particularly to FIG. 2, FIG. 2 illustrates a first embodiment of the present invention. The fixing device of FIG. 2 includes the heat roller 1, which has a separation layer on an outer periphery thereof. Anti-stick properties of the separation layer server to prevent toner and other substances from becoming attaching to the heat roller 1. The heat roller 1 is in press contact with a press roller 2. Inside of the heat roller 1, in a coaxial arrangement, a heater 3 is provided that heats the heat roller 1. As a consequence, when an image forming member, such as a paper, overhead projector film, etc. as an image forming member, are passed therebetween with the toner or other image forming substance applied thereto, heat from the heat roller 1 and pressure between the respective rollers 1 and 2 affix the toner to the image holding member. However, some of the toner (or more generally image forming substance) inadvertently collect on the surface of the heat roller 1.

In order to clean the surface of the heat roller 1, the web 4 (which may include a web that it is impregnated with oil, e.g., silicon oil, as well as a device for applying the oil, not shown) is rubbed against the surface of the heat roller 1 so as to remove the residual toner, dust and other impurities. For this purpose, a pay-out roller 6 pays out the web when the controller 111 sends a signal to motor 7 that rotates the take-up roller 8 and pulls the web 4 towards the take-up roller 8. A spring is shown to bias a tension roller 9 that sandwiches the web between the tension roller 9 and the heat roller 1.

Briefly returning to FIG. 7, as previously discussed, toner and other materials to be removed from the heat roller 1 collect as substance "W" at the edge of a nip portion "N" and for one-half of the nip portion, between the centered dashed line as shown and the downstream edge of the nip portion N, where downstream is in a moving direction of the web 4. Toner and the other impurities W only extend, as a general matter, to one-half of the nip portion N, at the dashed line, because the tension roller 9, has the greatest force at a center position. Accordingly, the toner and other impurities W do not move past this center portion as this is the location where the removal force of the web is greatest against the surface of the heat roller 1.

Returning to FIG. 2, the controller 111 includes a CPU 1112, which may be a general purpose microprocessor, digital signal processor, application specific integrated circuit (ASIC), core logic, programmable logic device, or the like that cooperates with computer instructions stored in memory 1114 connected thereto. The memory 1114 is an electrically erasable programmable ROM (EEPROM), although other ROM and RAM memory (semiconductor, optical, and magnetic media) may be used as well. More particularly, the computer instructions that implement the process and mechanisms according to the present invention are encoded in the memory 1114, and are readable by the CPU 1112. Thus, under control of the CPU 1112, the motor 7, and consequently the web 4, is actuated at different times and at different events as will be described herein.

A timer 1116, is provided to keep time for the CPU 1112 relative to certain predetermined events, such as after the copying operation has been completed, after a suspending mode of operation has been entered, after an irregularity, either during the copying operation or the suspending mode of operation has been performed, after a heater has been enabled or disabled, or the like. Each of these times and events have a common theme of cleaning the heat roller 1 during a non-copying mode of operation to prevent toner and other impurities from becoming strongly attached to the heat roller 1. A temperature sensor 1118 is also coupled to the CPU 1112 for providing temperature information to the CPU 1112. The temperature sensor 1118 is coupled (with a conductor, not shown) to temperature transducer 12, so as to sense a temperature of the heat roller 1. Alternatively, the temperature sensor 1118, may operate independently, or receive information from the heater 3 directly. An energy saving mode detector 1120 is also coupled to the CPU 1112, and is implemented as a register, holding a flag indicating whether the CPU 1112, has directed the apparatus to enter an energy saving mode of operation when the fixing device has not been used for a predetermined period of time, or if a general image forming apparatus controller directs the fixing apparatus to enter the energy saving mode of operation.

The web 4 is made of synthetic fabric, such as aramid fibers (aromatic polymide fibers), and polyethylene teraphthalate (PET) fibers. As previously discussed, a lubricant oil is impregnated with the web and a movement of the web, allows for an oil supply apparatus, not shown, to apply additional oil to the web.

Figures 3A, 3B, 3C:
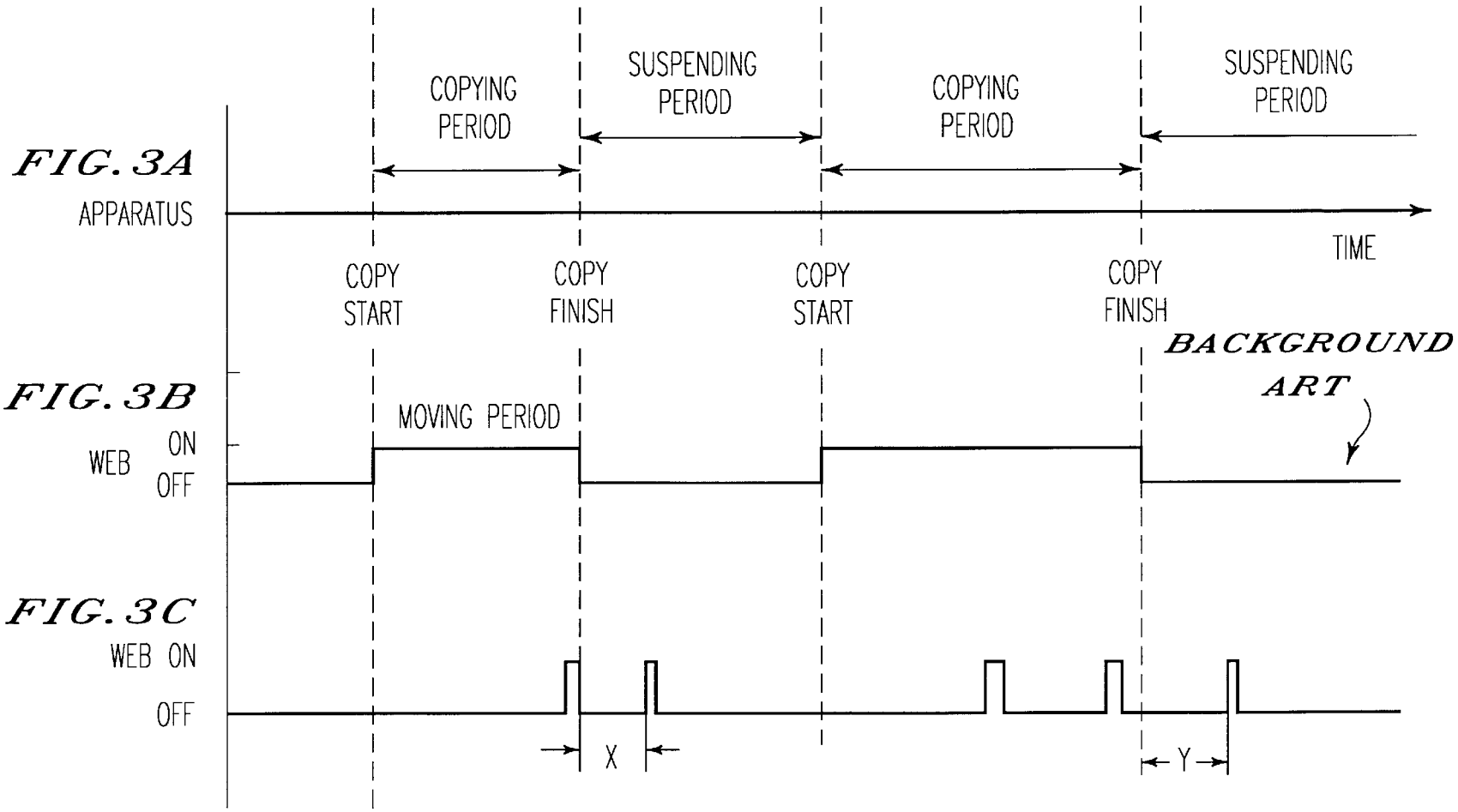
FIGS. 3*a*–3*c* are timing diagrams of an apparatus mode of operation, conventional web moving period, and a web moving period according to the first embodiment of the present invention.

FIG. 3A, 3B and 3C are timing diagrams presented on a common time axis (horizontal axis) for comparing a conventional web moving operation for a conventional device (FIG. 3B) with that of a first embodiment of the present invention (FIG. 3C) with respect to different modes of operation for the apparatus (FIG. 3A). FIG. 3A shows alternating periods between respective copying periods and suspending periods. During the copying periods, an image forming operation is performed, but during the suspending periods, the image forming operation is not performed, such that no additional copies or prints are made during this time interval.

FIG. 3B shows the respective periods of time in a conventional apparatus in which the web is moved. As shown, the web is moved only during the copying periods of operation. The web is not moved in the conventional apparatus, as shown in FIG. 3B during the suspending periods of operation. While FIG. 3B shows the web moving during the entire copying period, it is possible that the web is moved only for a portion of the time during the copying period.

FIG. 3C shows one example web moving scenario according to the present invention. In FIG. 3C the web moves at least for a subset of the copying period of time, although the web may move for the entire period of time during the copying period. More specifically, while the respective copying periods with respect to FIG. 3C show only a short duration of time during which the web is moved, as an alternative, the web may be moved for a longer or a shorter duration of time, or even for the entire copying period. Unlike the conventional apparatus, the fixing device of the present invention moves the web for a predetermined period of time and corresponding distance (corresponding to at least half of the nip portion N (see e.g., FIG. 7) at a time "X", after the copying period has ended. X may be immediately after the copying period or a predetermined period of time thereafter. Preferably $\alpha > X \geqq 0$, where $\alpha$ represents a time when the toner and other impurities W (see e.g., FIG. 7) begin to adhere strongly to the heat roller 1. The web may also be moved multiple times during the suspended period, although only one web movement operation is shown in the first suspending period of FIG. 3C. The web is also moved during the second suspending period, at a time "Y" after the end of the second copy period. Usually, X=Y, although Y may be different than X.

Figures 4A, 4B, 4C:
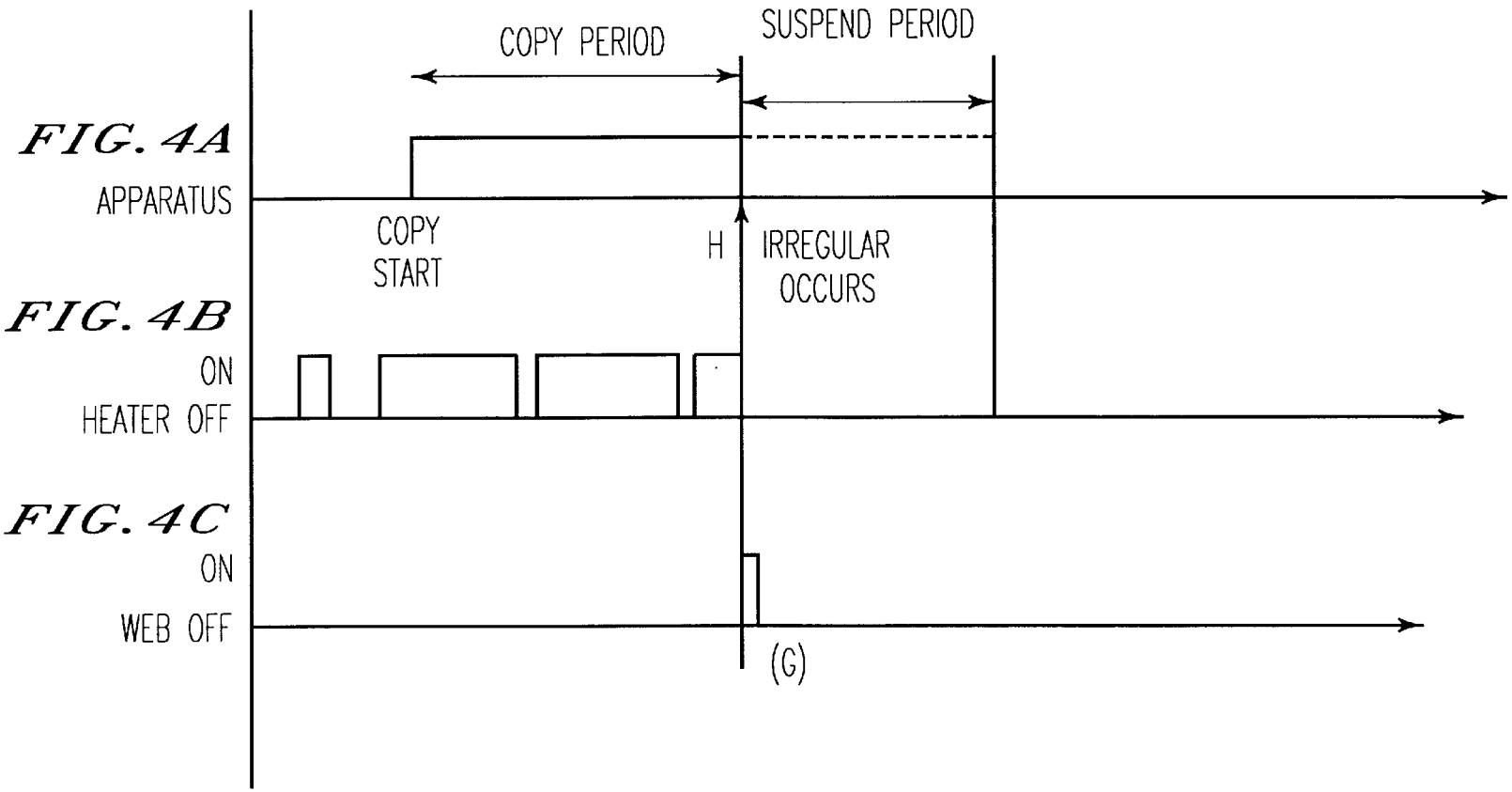
FIGS. 4A–4C, are timing diagrams of an apparatus operating period, heater operating period and web operating period respectively, during copying periods and suspending periods according to another embodiment of the present invention.

FIGS. 4A–4C show an alternative embodiment where the web is also moved during the suspended period of operation, but the web movement is triggered by the detection of an irregularity event. In particular, FIG. 4A shows a situation in which a copying mode of operation was initiated, but an irregularity occurred at time "H", such that the copying mode of operation could not be successfully completed. Thus, at the irregularity time H, the copying period ended and the suspending period began. FIG. 4B shows the heater's operational times during the copying period and during the suspended period. At the time H the heater is turned off and the heat roller 1 begins to cool after the irregularity H occurs. The irregularity may be a paper jam, out of toner indication, or other irregularity, associated with printers, image forming devices and other devices in which an image is formed on a recording medium.

FIG. 4C corresponds in time with FIGS. 4A and FIG. 4B. FIG. 4C, shows the web being moved, under control of the controller 111 (FIG. 2) immediately after the irregularity H occurs. However, the web moving operation may occur at a predetermined time after the irregularity H occurs. This predetermined time should not be greater than the amount of time required for the heat roller 1 to cool and have the residual toner, dust and other impurities to adhere strongly to the heat roller 1.

Figures 5A, 5B, 5C:
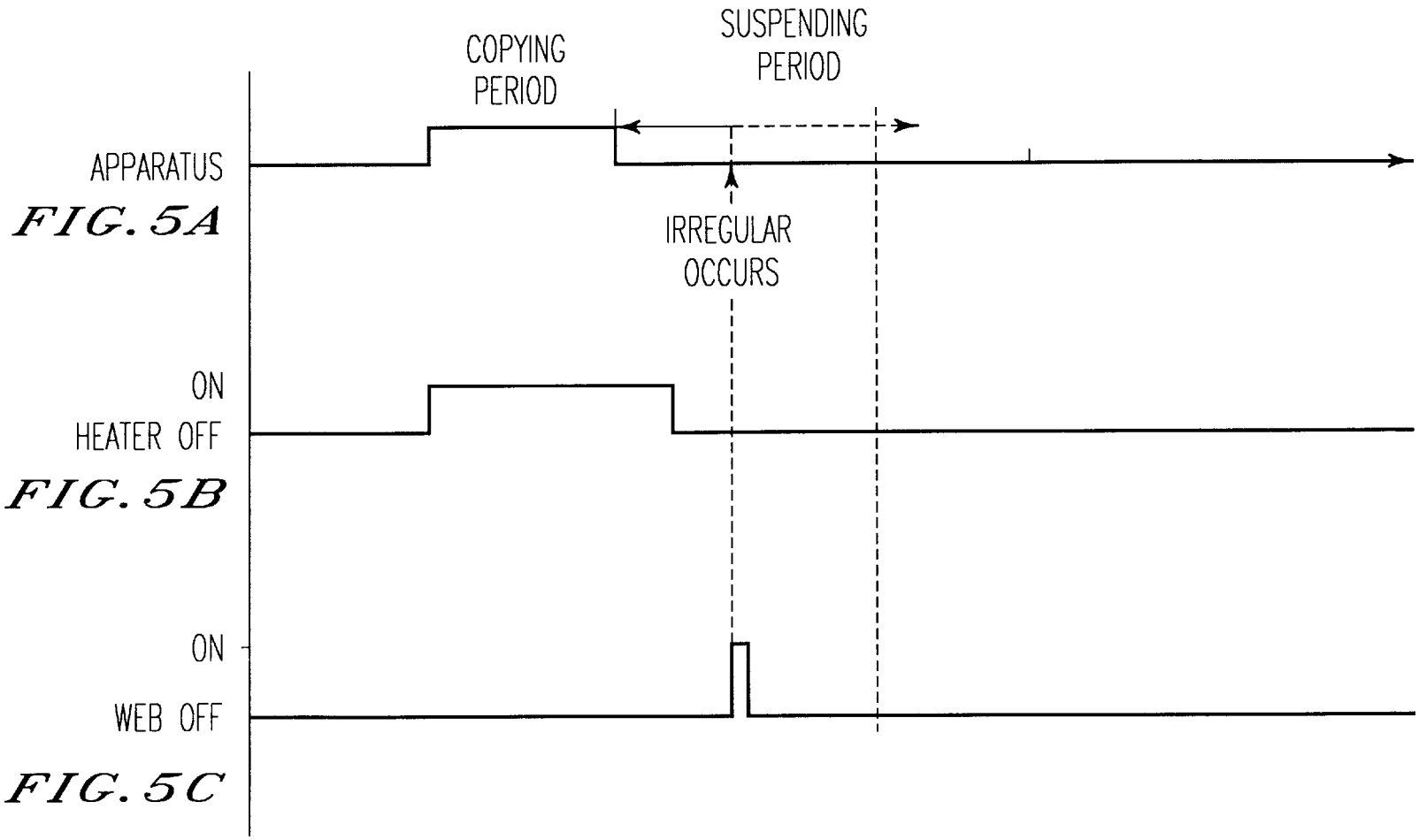
FIGS. 5A–5C are timing diagrams of an apparatus operating period, heater operating period and web operating periods according to another embodiment of the present invention.

FIGS. 5A–5C are similar to FIGS. 4A–4C, except the irregularity occurs during the suspending period of operation. Consequently, the controller 111 moves the web for a predetermined period of time after the irregularity occurs during a suspending period, so as to clear the nip portion N, and the portion immediately adjacent thereto of toner or other impurities that may have resulted during the irregularity event that triggered the web movement.

FIGS. 6A–6D, are presented to show another embodiment of the present invention in which the web is moved during an energy saving mode of operation that occurs during a suspending period. FIG. 6A shows a copying period, followed by a suspending period. During the suspending period, an energy saving mode of operation begins after a predetermined period of time after the copying period ends, or alternatively under operator control or control of a main controller of the image forming apparatus. As shown in FIG. 6B, the heater may be operated continuously during the copying period and then intermittently during the suspending period up until the time that the energy saving mode of operation is entered. At this time, the heater is turned off such that the heat roller 1 (FIG. 2) begins to cool and the impurities contained at the nip portion N and at the position immediately adjacent thereto, will begin to cool and strongly adhere to the heat roller 1. Consequently, the controller 111 (FIG. 2) moves the web immediately after entering the energy saving mode of operation so as to clean the nip portion N and the position immediately adjacent thereto. Alternatively, the web is controlled by the controller 111 to move after a predetermined amount of time X as shown where the value X is bounded on the low end by 0 and on the high end by $\alpha$, where $\alpha$ is a predetermined period of time on which the toner and other impurities may begin to affix to the heat roller 1 (e.g., after 1 minute or 5 minutes). The time X may be determined by the timer 116 (FIG. 2), or a temperature sensor 1118 (FIG. 2), in cooperation with the energy saving mode detector 1120.

Figure 7:
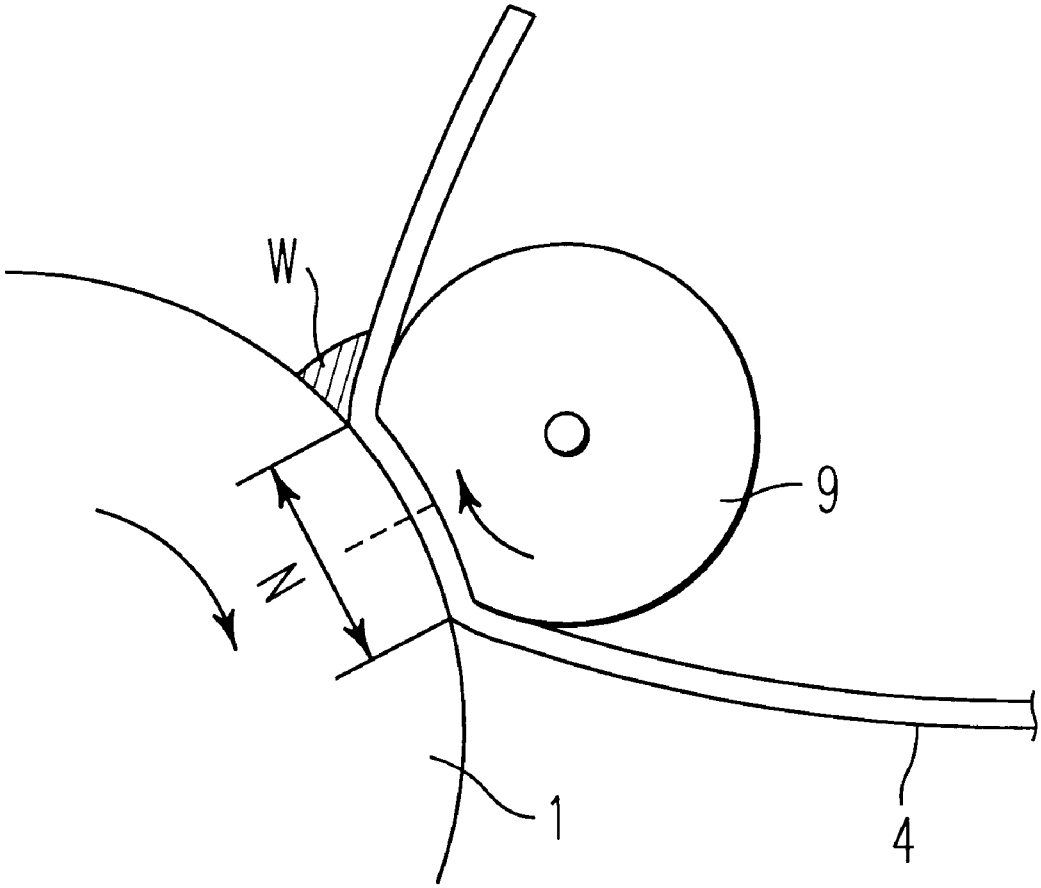
FIG. 7 is a side view of a web being sandwiched between a press roller and a heat roller, and showing a nip portion between the respective rollers with toner and other impurities that collect therebetween.

FIG. 7 has previously been discussed, and shows the nip portion N between the tension roller 9 and heat roller 1, as well as the position immediately adjacent thereto that captures the residual toner and other impurities that collect as a result of routine, and even abnormal copying operations.

Figure 8:
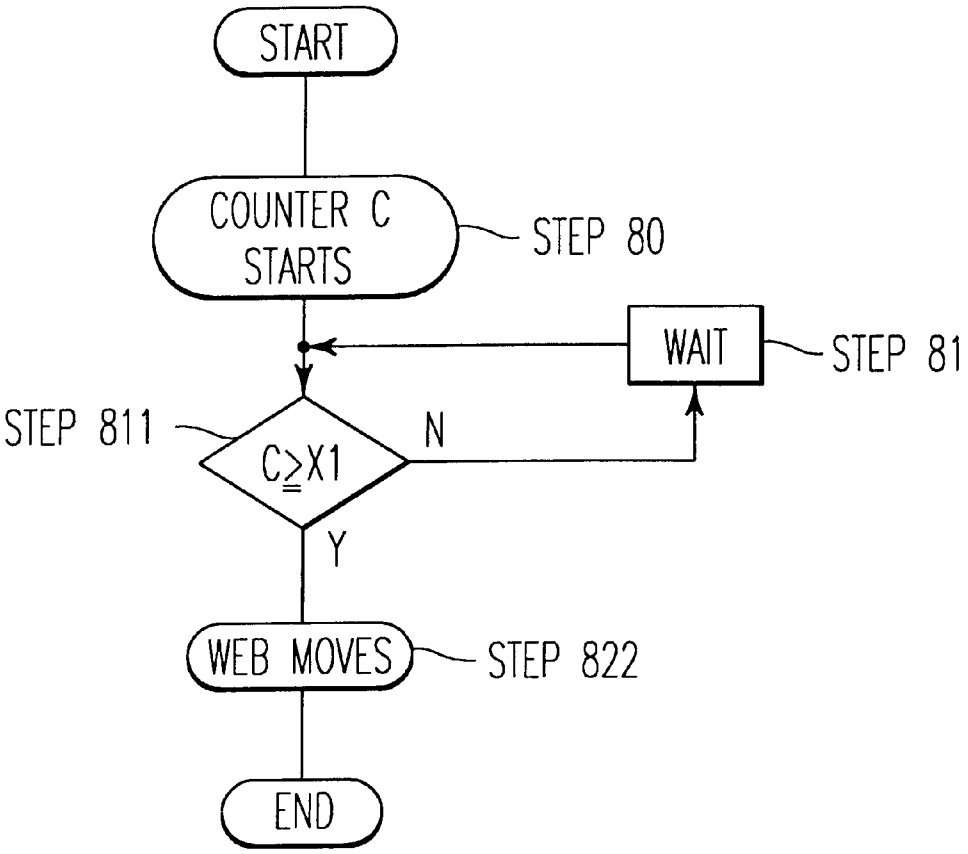
FIG. 8 is a flowchart of a process implemented by a controller according to the present invention.

FIG. 8 is a flowchart of a web moving method according to the present invention. The method is implemented by the controller 111 (FIG. 2) when executing instructions encoded in the memory 1114 (FIG. 2). The process begins in step S80, where a counter begins a count C when the heater is turned off. The process the proceeds to step 811 where a determination is made whether the count C equals or exceeds a predetermined amount X. If the response to the inquiry in step S111 is negative, the process proceeds to step S81 where the process waits for a predetermined period of time (e.g., 1 second) before returning to the inquiry in step 811. However, if the response to the inquiry in step 811 is affirmative, the process moves to step 822 where the processor controls a movement of the web for a predetermined amount of time so as to clear the nip portion N and the portion adjacent thereto to be free of toner and other impurities. Subsequently the process ends.

Figure 9:
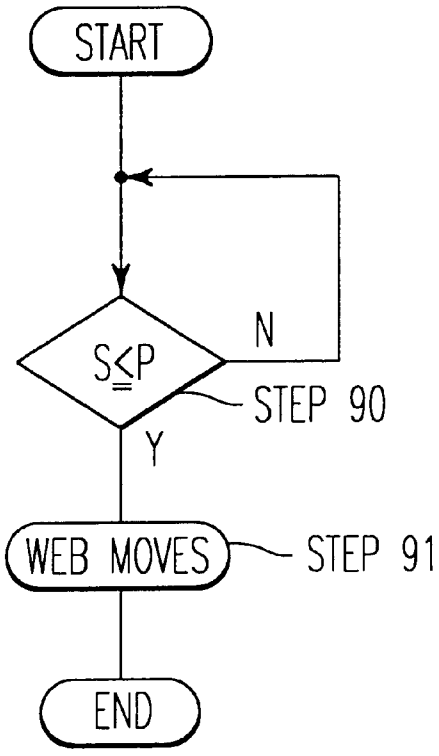
FIG. 9 is another flowchart of another process implemented by the controller according to the present invention.

FIG. 9 is a flowchart showing another method according to the present invention. The method in FIG. 9 begins when the heater is turned off, although as an alternative, the process need not begin upon determining that the heater has been turned off. An inquiry is made in step 90 to determine whether the surface of the heat roller 1, S, is equal to or less than a predetermined temperature, P. If the response to the inquiry in step 90 is negative, the process returns to the inquiry of step 90. However, if the response to the inquiry is affirmative, the process proceeds to step S91 where the controller 111 moves the web for a predetermined period of time so as to clear the nip portion N and the portion immediately adjacent thereto to be free of residual toner and other impurities that collect between the nip portion N and the portion immediately adjacent thereto.

The processes and control mechanisms set forth in the present description may be implemented using a conventional general purpose microprocessor programmed according to the teachings of the present specification, as will be appreciated to those skilled in the relevant art(s). Appropriate software coding can readily be prepared by skilled programmers based on the teachings of the present disclosure, as will also be apparent to those skilled in the relevant art(s).

The present invention thus also includes a computer-based product which may be hosted on a storage medium and include instructions which can be used to program a computer to perform a process in accordance with the present invention. The storage medium can include, but is not limited to, any type of disk including floppy disk, optical disk, CD-ROMS, and magneto-optical disks, ROMS, RAMs, EPROMs, EEPROMs, flash memory, magnetic or optical cards, or any type of media suitable for storing electronic instructions.

Obviously, numerous additional modifications and variations of the present invention are possible in light of the above teachings. It is therefore to be understood that within the scope of the appended claims, the present invention may be practiced otherwise than as specifically described herein.

The present document has as priority documents Japanese Patent Applications Nos. JP 09-110907, filed on Apr. 28, 1997 in the Japanese Patent Office, and JP 09-149152, filed on Jun. 6, 1997 in the Japanese Patent Office, the entire contents of both of which are incorporated herein by reference.

We claim:

1. A device comprising:

a fixing unit configured to be heated by a heater so as to fix an image forming substance to an image holding member during a copy mode of operation;

a web having a surface;

a positioning mechanism configured to place said surface of said web in pressure contact with the fixing unit at a nip portion;

a web driving mechanism; and a controller configured to actuate the web driving mechanism for a predetermined interval during a suspending mode of operation and after stopping the web after completion of the copy mode of operation such that said surface of said web moves relative to said fixing unit and cleans the nip portion of the fixing unit so as to prevent impurities that collect on the fixing unit adjacent said web during the suspending mode of operation from becoming strongly adhered to the fixing unit.

2. The device of claim 1, wherein:

said fixing unit includes a fixing roller and the heater, said heater being contained within an outer circumferential surface of the fixing roller.

3. The device of claim 1, wherein:

said web being configured to clean said impurities from the nip portion of said fixing unit and an upstream portion of said fixing unit relative to said nip portion and with respect to a moving direction of said web.

4. The image forming device of claim 1, wherein:

said web being impregnated with oil.

5. The device of claim 1, wherein:

said web comprises an aromatic polyamide fiber material and a polyethylene terephthalate material.

6. The device of claim 1, wherein said web driving mechanism further comprises:

a supply spool that pays out the web; and a take-up spool that rolls up the web after being payed out by the supply spool.

7. The device of claim 1, wherein said predetermined interval comprises at least one of:

a time interval corresponding to a time period sufficient for said web driving mechanism to drive said web for a distance greater than or equal to one-half of said nip portion; and a distance interval corresponding to a lineal length being greater than or equal to one-half of said nip portion.

8. The device of claim 1, wherein;

said controller being programmed to stop said web driving mechanism after said copy mode of operation and later actuate said web driving mechanism for a predetermined period of time, X, where X>0 relative to when the copy mode of operation has been completed.

9. The device of claim 8, further comprising:

means for determining when a residual image forming substance on said fixing unit cools to below a set temperature, wherein, $X<\alpha$, where $\alpha$ being the time when the residual image forming substance on said fixing unit cools to below the set temperature after the heater in said fixing unit is turned off.

10. The device of claim 1, wherein:

said controller is configured to stop the web driving mechanism at a conclusion of the copy mode of operation and later start the web driving mechanism during a time period when no copies are being made.

11. The device of claim 1, wherein:

the controller is configured to detect a predetermined event and to actuate the web driving mechanism at a time X>0 when said predetermined event is detected, said predetermined event being at least one of, an irregularity during the copy mode of operation, an irregularity during the suspending mode of operation, and a presence of a transition to an energy saving mode of operation.

12. The device of claim 11, further comprising:

means for determining when a residual image forming substance on said fixing unit cools to below a set temperature, wherein, $0<X<\alpha$, where $\alpha$ being the time during which the residual image forming substance on said fixing unit cools to below the set temperature after the heater in said fixing unit is turned off.

13. The device of claim 1, further comprising:

a timer that establishes said predetermined interval relative to when the heater turns off, wherein said controller being configured to actuate the web driving mechanism after said timer reaches a predetermined count.

14. The device of claim 1, further comprising:

a temperature sensor, wherein said controller is configured to actuate said web driving mechanism when said temperature sensor determines that a temperature of said fixing unit is less than or equal to a predetermined temperature.

15. The device of claim 1, further comprising:

an image forming unit having a mechanism that applies the image forming substance to a recording sheet; and a recording sheet transportation mechanism disposed between said fixing unit and said image forming unit so as to transport said recording sheet from said image forming unit to said fixing unit.

16. The device of claim 1, wherein said controller comprises:

a processor; and a memory, said memory having encoded therein a computer program code mechanism including, a triggering mechanism that triggers an actuation of said web driving mechanism so as to enable said web driving mechanism to move said web for said predetermined interval.

17. A device comprising:

means for applying heat and pressure to a recording medium having an image forming substance disposed thereon and for fixing the image forming substance on the recording medium during an image forming operation;

means for cleaning said means for applying heat and pressure;

means for stopping said means for cleaning after said image forming operation and subsequently moving said means for cleaning during a suspending mode of operation so as to prevent said means for applying heat and pressure from being damaged as a result of impurities becoming affixed to said means for applying heat and pressure when said means for applying heat and pressure cools below a predetermined fixing temperature; and means for determining an event that triggers said means for moving so as to prevent the means for applying heat and pressure from being damaged.

18. The device of claim 17, wherein:

said means for determining determines when a predetermined event occurs, said predetermined event including at least one of, a temperature of said means for applying heat and pressure drops below a predetermined temperature, a predetermined non-zero period of time expires after completion of the image forming operation, an irregularity event occurs during the image forming operation, and another irregularity event occurs during the suspending mode of operation.

19. The device of 17, further comprising:

means for forming an image on the recording medium; and means for transporting the recording medium to said means for applying heat and pressure.

20. A method comprising, the steps of:

heating a fixing device;

applying pressure to a recording medium having an image forming substance disposed thereon and fixing the image forming substance on the recording medium during an image forming operation;

positioning a web against a surface of said fixing device;

stopping said web after said image forming operation;

restarting said web during a suspending mode of operation and removing residual image forming substance from said fixing device before said residual image forming substance becomes securely fixed to said fixing device; and determining an event that initiates the restarting step so that the moving step is performed before the residual image forming substance becomes securely fixed to said fixing device.

* * * * *